US012624517B2

(12) United States Patent
Cui

(10) Patent No.: US 12,624,517 B2
(45) Date of Patent: May 12, 2026

(54) ENGINEERING METHOD FOR REINFORCING AND LIFTING A SUNKEN FOUNDATION OF A RESIDENTIAL BUILDING

(71) Applicant: BEIJING HENGXIANG HONGYE FOUNDATION REINFORCEMENT TECHNOLOGY CO., LTD., Beijing (CN)

(72) Inventor: Tengyue Cui, Beijing (CN)

(73) Assignee: BEIJING HENGXIANG HONGYE FOUNDATION REINFORCEMENT TECHNOLOGY CO., LTD., Beijing (CN)

( * ) Notice: Subject to any disclaimer, the term of this patent is extended or adjusted under 35 U.S.C. 154(b) by 82 days.

(21) Appl. No.: 18/678,047

(22) Filed: May 30, 2024

(65) Prior Publication Data

US 2024/0318400 A1 Sep. 26, 2024

Related U.S. Application Data

(63) Continuation of application No. PCT/CN2023/076566, filed on Feb. 16, 2023.

(30) Foreign Application Priority Data

Feb. 16, 2022 (CN) ..... 202210140290.4

(51) Int. Cl.
*E02D 35/00* (2006.01)
*E02D 1/08* (2006.01)
(Continued)

(52) U.S. Cl.
CPC ..... *E02D 35/005* (2013.01); *E02D 1/08* (2013.01); *E02D 3/12* (2013.01); *E02D 37/00* (2013.01); *E02D 2600/40* (2013.01)

(58) Field of Classification Search
CPC .. E02D 1/08; E02D 3/12; E02D 35/00; E02D 35/005; E02D 37/00
See application file for complete search history.

(56) References Cited

U.S. PATENT DOCUMENTS 11,453,992 B2 * 9/2022 Cui ..... E02D 35/005
11,732,434 B2 * 8/2023 Cui ..... E02D 27/34 405/230

(Continued)

FOREIGN PATENT DOCUMENTS

AU 2011203301 B1 * 9/2011 ..... E02D 35/00
CN 108842840 A * 11/2018 ..... E02D 35/005

(Continued)

OTHER PUBLICATIONS

International Search Report for corresponding International Patent Application No. PCT/CN2023/076566, mailed May 24, 2023, 7 pages.

*Primary Examiner* — Frederick L Lagman
(74) *Attorney, Agent, or Firm* — Cooper Legal Group, LLC

(57) ABSTRACT

An engineering method for reinforcing and lifting a sunken foundation of a residential building includes stratigraphic structure, conducting a curtain reinforcement, reinforcing and strengthening a shallow layer, reinforcing a deep layer, steadily lifting an intermediate layer, and reinforcement supports of the composite foundation, the shallow layer reinforcement and strengthening adopts a progressive layered reinforcement process, the foundation slab of the building is reinforced with grouting to form the reinforcement body of an integral raft composite foundation. A support of the composite foundation similar to the pile foundation is constructed under four corners of the building and under the main load-bearing walls of the room. A structure supporting (Continued)

the upper load is formed through repeated retreating and progressive grouting.

9 Claims, 7 Drawing Sheets

(51) Int. Cl.
*E02D 3/12* (2006.01)
*E02D 37/00* (2006.01)

(56) References Cited

U.S. PATENT DOCUMENTS 11,739,495 B2 * 8/2023 Cui ..... E02D 35/005
405/230
11,746,496 B2 * 9/2023 Cui ..... E02D 19/18
405/229
11,840,820 B2 * 12/2023 Cui ..... E02D 3/12

FOREIGN PATENT DOCUMENTS

| | | | | | |
|---|---|---|---|---|---|
| CN | 112343104 | A | * | 2/2021 | ..... E01D 22/00 |
| CN | 112343106 | A | | 2/2021 | |
| CN | 112663694 | A | * | 4/2021 | |
| CN | 112942455 | A | | 6/2021 | |
| CN | 113338303 | A | * | 9/2021 | ..... E02D 17/04 |
| CN | 114319472 | A | | 4/2022 | |
| JP | S6140927 | A | | 2/1986 | |
| KR | 100475443 | B1 | | 3/2005 | |
| KR | 101803336 | B1 | | 12/2017 | |

* cited by examiner curtain hole
curtain hole
curtain hole

ENGINEERING METHOD FOR REINFORCING AND LIFTING A SUNKEN FOUNDATION OF A RESIDENTIAL BUILDING

CROSS-REFERENCE TO RELATED APPLICATIONS

This application is a continuation of PCT application serial no. PCT/CN2023/076566, filed on Feb. 16, 2023, which claims the priority and benefit of Chinese patent application serial no. 202210140290.4, filed on Feb. 16, 2022. The entireties of PCT application serial no. PCT/CN2023/076566 and Chinese patent application serial no. 202210140290.4 are hereby incorporated by reference herein and made a part of this specification.

TECHNICAL FIELD

The present disclosure relates to an engineering for reinforcing and lifting a foundation of a residential building, and specifically to an engineering method for reinforcing and lifting a sunken foundation of a residential building, which belongs to the technical field of processing and lifting of building foundation.

STATE OF THE ART

In the building construction, the raft foundation is widely used because of its high bearing capacity, adaptivity to the soil layer of the foundation with low bearing capacity and good integrality. With the construction of high-rise or super-high-rise buildings, the requirements for geological conditions of the sites where the buildings are located are higher.

The soil layer of the building foundation is mainly composed of silty clay and silt, which are moderately and highly compressible soil layers and are uneven foundation with low foundation bearing capacity. Poor soil property of the foundation itself is an important reason for the uneven settlement of a building. In addition, for units located in the alluvial floodplain of the Yellow Sea, the water table is relatively high. The foundation is eroded by the ground water for a long time, such that the soil layer is weakened, which also causes uneven settlement. However, a large area of foundation soil near the building will cause a relative serious settlement of the soil mass around pile of the pile foundation due to the pile load, which generates a negative friction on the pile body. In addition, the lateral deformation of the soil mass around pile will squeeze the adjacent pile foundation, which causes the pile body to move horizontally and to flexurally deform. When the pile top is subjected to a load, the load on the pile top interacts with the negative friction and lateral extrusion force, the working performance of the pile foundation will be affected, and large secondary bending moments and shear forces will even be caused, so that the pile body breaks.

SUMMARY

The purpose of the present disclosure is to provide an engineering method for reinforcing and lifting a sunken foundation of a residential building to solve the aforementioned problem.

In order to achieve the purpose of the present disclosure, an engineering method for reinforcing and lifting a sunken foundation of a residential building is provided, which includes the following steps:

Step 1: exploring stratigraphic structure, and dividing the stratum within the exploration depth into 9 layers according to differences such as the soil type, color, state and inclusions etc., and in particular, the characteristics and distribution of each soil layer are as follows:

The first layer is a slightly dense silt layer, the second layer is a slightly dense silty clay layer, the third layer is a medium dense silt layer, the fourth layer is a layer of silt interspersed with silty clay, the fifth layer is a silt layer, the sixth layer is a plastic silty clay layer, the seventh layer is a fine sand layer, the eighth layer is a plastic-hard plastic silty clay layer, and the ninth layer is a fine sand layer;

Step 2: conducting a curtain reinforcement, a curtain grouting reinforcement is conducted around the building, particularly, a retreating layered reinforcement by a jumping drilling method is adopted for construction, the drill rod is lifted 0.5 to 1.0 m after each section is reinforced, the reinforcement is continued and circulated upward to the foundation slab, so a curtain wall is formed around the building foundation;

Step 3: reinforcing and strengthening a shallow layer, in particular, the silty clay layer under the foundation slab is reinforced and strengthened to improve the density and rigidity of the soil layer of foundation, to act as a buffer zone during lifting, so that the lifting force is more uniform;

Step 4: reinforcing a deep layer, in particular, the drilling continues down to a fifth layer of silt, and the retreating layered reinforcement of the soil around the original pile is started, to increase the friction resistance of the soil around the pile and form an integral stone body;

Step 5: steadily lifting an intermediate layer, in particular, after an upper layer and lower layer of the reinforcement bodies are completed, they are steadily lifted in the intermediate foundation layer on the settlement side, a grouting pressure and slurry proporation are properly adjusted on the settlement side to continuously fill and compact the soil layer of foundation with the slurry, with the increase of the density and the pressure, the soil layer of foundation generates a lifting force, so as to achieve the lifting effect on the building, which not only improves the bearing capacity of the foundation, but also achieves the rectification of building lifting (the rectification amount of lifting should be determined according to the actual situation on site and the safety of the building structure); after the foundation reinforcement and lifting is completed, an integral raft composite foundation is formed;

Step 6: constructing reinforcement supports of the composite foundation, in particular, a plurality of reinforcement supports of the composite foundation are constructed under the raft composite foundation formed after the building reinforcement and lifting meets the requirements, and the reinforcement depth is about 3 m below a pile bottom, so as to improve the bearing capacity of the bearing layer at the pile end, to meet the requirements for the settlement stability of the building foundation.

In a further schema, in the step 1, the hole positions for the curtain reinforcement are arranged outside the foundation slab with the spacing of the hole positions of about 2.5 m, in particular, the hole depth is 12.0 m below the foundation slab, and the range of the curtain reinforcement is the outward expansion by 3.0 m of the building foundation.

In a further schema, in the steps 2 and 3, the reinforcement holes are all indoor arranged in plum blossom shape and drilled vertically, the drilling depth for reinforcing and strengthening the shallow layer is 4.0 m below the foundation slab, and the drilling depth for reinforcing the deep layer is 7.0 m to 12 mm below the foundation bottom, and the range for reinforcing and strengthening the shallow layer and the range for reinforcing the deep layer are both the total area reinforcement of the raft foundation.

In a further schema, in the step 5, a part of the reinforcement holes is used as lifting holes on a side of the sunken building, and the hole depth is 4.0 m to 7.0 m below the foundation slab.

The beneficial effect of the present disclosure is in that:

1. the shallow layer reinforcement and strengthening adopts a progressive layered reinforcement process, so as to stabilize the foundation and reduce the settlement rate. The purpose of the shallow layer reinforcement and strengthening is to act as a buffer zone during lifting, so that the lifting force is more uniform;
2. the deep layer filling and reinforcement adopts a retreating layered reinforcement, the drill rod is lifted 0.3 to 0.5 m after each section is reinforced, grouting reinforcement is continued, the soil layer of foundation reaches a uniform and dense structure through the layer-by-layer reinforcement manner;
3. after the building lifting height reaches the requirement, the foundation below the total plane foundation slab of the building is reinforced with grouting to form an integral raft composite foundation reinforcement body, so that the building foundation can meet the settlement stability requirements and the purpose of rectification.
4. a composite foundation support similar to the pile foundation is constructed under the four corners of the building and under the main load-bearing walls of the room, a structure supporting the upper load is formed through repeated retreating and progressive grouting. After the reinforcement of the building foundation is completed, the building foundation will meet the settlement stability requirements and the purpose of rectification.

DETAILED EMBODIMENTS

The technical solutions in the embodiments of the present disclosure will be clearly and completely described below in conjunction with the accompanying drawings in the embodiments of the present disclosure. Obviously, the described embodiments are only part of the embodiments of the present disclosure, rather than all embodiments. Based on the embodiments of the present disclosure, all other embodiments obtained by those of ordinary skill in the art without making any creative work shall fall within the protection scope of the present disclosure.

Embodiment 1

Figure 1:
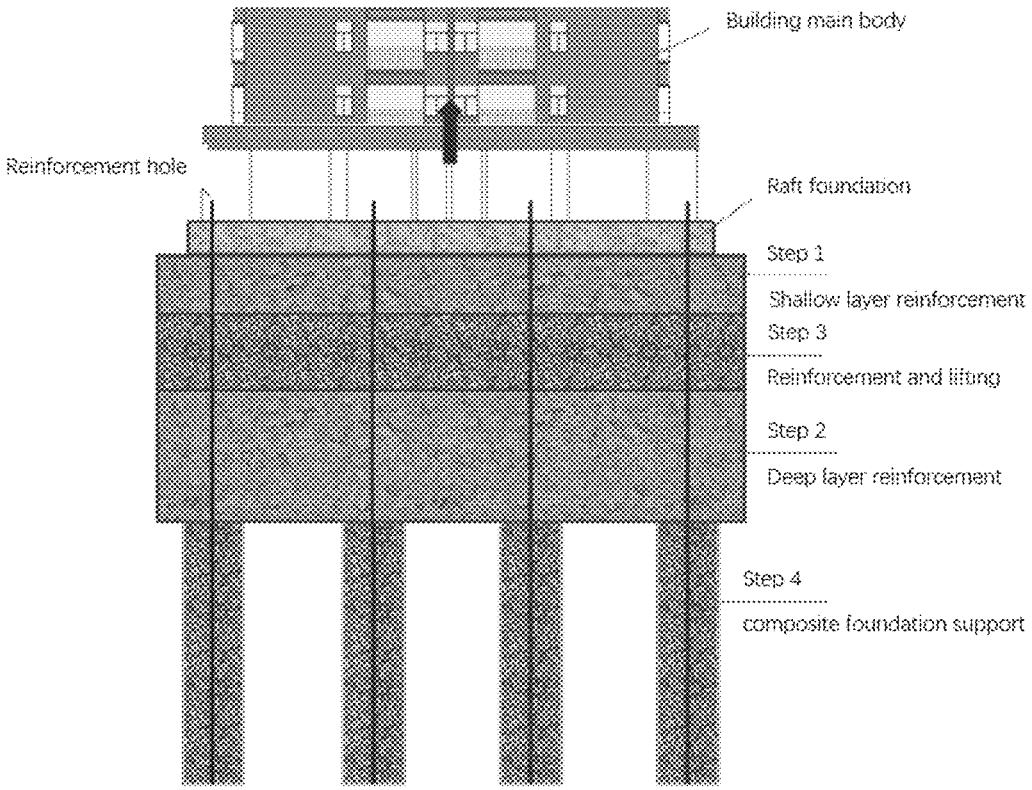
FIG. 1 is a schematic diagram showing the building lifting principle of the present disclosure.

Referring to FIG. 1, an engineering method for reinforcing and lifting a sunken foundation of a residential building includes following steps:

Step 1: exploring stratigraphic structure, and dividing the stratum within the exploration depth into 9 layers according to differences such as the soil type, color, state and inclusions etc., and the characteristics and distribution of each soil layer are as follows:

The first layer is a slightly dense silt layer, the second layer is a slightly dense silty clay layer, the third layer is a medium dense silt layer, the fourth layer is a layer of silt interspersed with silty clay, the fifth layer is a silt layer, the sixth layer is a plastic silty clay layer, the seventh layer is a fine sand layer, the eighth layer is a plastic-hard plastic silty clay layer, and the ninth layer is a fine sand layer;

Step 2: conducting a curtain reinforcement, in particular, a curtain grouting reinforcement is conducted around the building, particularly, a retreating layered reinforcement by a jumping drilling method is adopted for construction, the drill rod is lifted 0.5 to 1.0 m after each section is reinforced, the reinforcement is continued and circulated upward to the foundation bottom, so a curtain wall is formed around the building foundation;

Step 3: reinforcing and strengthening a shallow layer, in particular, the silty clay layer under the raft foundation is reinforced and strengthened to improve the density and rigidity of the soil layer of foundation, to act as a buffer zone during lifting, so that the lifting force is more uniform;

Step 4: reinforcing a deep layer, in particular, the drilling continues down to a fifth layer of silt, and the retreating layered reinforcement of the soil around the original pile is started, to increase the friction resistance of the soil around the pile and form an integral stone body;

Step 5: steadily lifting an intermediate layer, in particular, after an upper layer and lower layer of the reinforcement bodies are completed, they are steadily lifted in the intermediate foundation layer on a settlement side, a grouting pressure and a slurry proporation are properly adjusted on the settlement side to continuously fill and compact the soil layer of foundation with the slurry, with the increase of the density and the pressure, the soil layer of foundation generates a lifting force, so as to achieve the lifting effect on the building, which not only improves the bearing capacity of the foundation, but also achieves the rectification of building lifting (the rectification amount of lifting should be determined according to the actual situation on site and the safety of the building structure); after the foundation reinforcement and lifting is completed, an integral raft composite foundation is formed;

Step 6: constructing reinforcement supports of the composite foundation, in particular, a plurality of reinforcement supports of the composite foundation are constructed under the raft composite foundation formed after the building reinforcement and lifting meets the requirements, and the reinforcement depth is about 3 m below a pile bottom, so as to improve the bearing capacity of the bearing layer at the pile end, to meet the requirements for the settlement stability of the building foundation.

In the step 1 of the embodiment of the disclosure, the characteristics and distribution of each soil layer specifically include:

Slightly Dense Silt Layer:

yellowish brown, wet, slightly dense, quick shaking response, uniform soil, no glossiness, low dry strength, low toughness, locally manifested as a thin layer of loose silt sand, the surface layer is a cultivated soil, containing a small amount of plant roots, and partially interspersed with plastic silty clay;

Slightly Dense Silty Clay Layer:

yellowish brown, wet, slightly dense, medium shaking response, uniform soil, no glossiness, low dry strength, low toughness, containing iron spots, mica sheets and small amount of ginger stone, high local clay content, interspersed with a thin layer or a lens of soft plastic-plastic silty clay;

Medium Density Silt Layer:

yellowish brown, wet, medium dense, low dry strength, quick shaking response, no glossiness, low toughness; locally interspersed with a thin layer of silt sand, relative high content of sand particles, mainly composed of quartz and feldspar, discontinuous distribution, and locally pinching out;

Layer of Silt Interspersed with Silty Clay:

yellowish brown-brownish gray, wet, slightly dense, medium shaking response, no glossiness, low dry strength, low toughness, interspersed with a thin layer or a lens of soft plastic-plastic silty clay;

Silt Layer:

yellowish brown, wet, slightly dense, low dry strength, medium shaking response, no glossiness, low toughness; locally mixed with a powdery thin layer, containing a small amount of mica sheets and iron oxides;

Plastic Silty Clay Layer:

gray brown, mainly plastic, medium dry strength, no shaking response, medium toughness, slightly glossy, with small amounts of iron oxides, small ginger stones, calcium nodules, snail scraps, etc., locally interspersed with a medium dense hard layer of silt;

Fine Sand Layer:

yellowish brown, saturated, dense, with average particle size distribution, with main mineral components of quartz and feldspar, containing iron and manganese, mica sheets, occasional snail debris and small ginger stone;

Plastic-Hard Plasitc Silty Clay Layer:

brownish yellow, plastic-hard plastic, medium dry strength, no shaking response, medium toughness, slightly glossy, with a small number of calcareous nodules, snail crumbs, etc., locally interspersed with a medium dense thin layer of silt.

In the step 1 of the embodiment of the disclosure, the hole positions for the curtain reinforcement are arranged outside the foundation slab with the spacing of the hole positions of about 2.5 m, in particular, the hole depth is 12.0 m below the foundation slab, and the range of the curtain reinforcement is the outward expansion by 3.0 m of the building foundation.

In the steps 2 and 3 of the embodiment of the disclosure, the reinforcement holes are all indoor arranged in plum blossom shape and drilled vertically, the drilling depth for reinforcing and strengthening the shallow layer is 4.0 m below the foundation slab, and the drilling depth for reinforcing the deep layer is 7.0 m to 12 mm below the foundation bottom, and the range for reinforcing and strengthening the shallow layer and the range for reinforcing the deep layer are both the total area reinforcement of the raft foundation.

In the step 5 of the embodiment of the disclosure, a part of the reinforcement holes is used as lifting holes on a side of the sunken building, the hole depth is 4.0 m to 7.0 m below the foundation slab.

In the step 5 of the embodiment of the disclosure, the slurry is a high-aluminum-iron composite slurry for grouting construction, the slurry is filled into the gaps in the soil layer of foundation and consolidated to a new structure.

The grouting liquid formula is available for use: Slurry A is composed of the following raw materials in parts by weight: 70-90 parts by weight of metal oxides and/or metal hydroxides, 0.5-1.2 parts by weight of composite retarder, 0.5-0.7 parts by weight of water reducer, 0.7-1.5 parts by weight of acid-base buffer, 3-5 parts by weight of composite stabilizer, and 0.5-1.5 parts by weight of composite surfactant. In particular, the metal oxide can be a combination of any two of magnesium oxide, aluminum oxide, magnesium phosphate, etc.; the composite retarder is urea and sodium tripolyphosphate; the water reducer is a polycarboxylic acid water reducer; the acid-base buffer is magnesium carbonate or potassium hydroxide; the composite stabilizer is at least two of hydroxymethyl cellulose, n-alkyl hexadecanol, starch ether and cellulose ether; the composite surfactant is at least two of alkyl polyoxyethylene ether, benzylphenol polyoxyethylene ether and alkyl sulfonate. When two or more different materials of the above individual components shall be used, they can be prepared in equal orders of magnitude. Two materials are provided to mainly prevent the failure of one of them, so that the overall composite slurry effect is more stable. Slurry B is composed of the following raw materials in parts by weight: 30-40 parts by weight of phosphate and 0.2-1 part by weight of defoamer. In particular, the phosphate may be diammonium hydrogen phosphate or potassium dihydrogen phosphate; the defoamer may be an organosilicon defoamer or a polyether defoamer. Slurry A and Surry B are respectively mixed with water in a weight ratio of 100:40-50 to form slurries, which are pressed into the grouting pipes through different pipelines, converge and react at the slurry outlet, and solidify in the soil. The difference in initial solidification time of the composite slurry is mainly achieved by adjusting the proportion of the composite retarder. Preferably, during the pressure grouting in the lifting process, less water should be added to increase the concentration of the grouting liquid, so as to better squeeze the surrounding soil (for example, the weight ratio of slurry A and slurry B to water is 100:40 respectively); during other grouting, more water should be added and the concentration of the grouting liquid should be lower (for example, the weight ratio of slurry A and slurry B to water is 100:50 respectively).

In the step 6 of the embodiment of the disclosure, the supports of the composite foundation are arranged under four corners of the building and under the main load-bearing walls.

In the embodiment of the disclosure, the grouting reinforcement pressure is 0.3 to 1.2 MPa, and the grouting lifting pressure is 0.5 to 2.5 MPa by the grouting construction.

In the embodiment of the disclosure, the grouting construction specifically includes:

Determining the Hole Positions

According to the drawings, positioning marks are made according to the actual situation on site. The holes are vertically or obliquely drilled, and adjusted according to the specific conditions on site; at the drilling point, the construction personnel must drill holes strictly according to the requirements.

Placing a Drilling Rig in Place

After the drilling rig is in place, the drilling rig is leveled and centered, and the angle of the drill rod is adjusted, after the drilling rig is aligned with the respective hole position, the drilling rig should not be moved, the drilling rig idles before drilling, to ensure the normal construction of the drilling rig.

Forming Holes with the Drilling Rig

A drilling-injection machine is used for forming holes, and the drilling diameter is 42 mm. Before drilling, a concrete protective layer is removed and the holes are formed between adjacent rebars. Combined with the actual situation on site, during forming holes, the construction worker pays attention to the changes in the holes at any time to ensure a smooth drilling. Good records during drilling are taken, to provide reference data for grouting operations.

Preparing Slurry

In order to control the gelation time of the slurry and the diffusion radius of the slurry, and to obtain a good grouting and sealing effect, the gelation time of the slurry can be accurately controlled within a few seconds to tens of minutes according to engineering experience, and the gelation time thereof requires a reasonable ratio to achieve an ideal state.

A feed is carried out in strict accordance with the proportion, in particular, rope ends, pieces of paper and other sundries cannot be put into the blender during stirring, and the stirred slurry must be filtered through a screen before entering the grouting machine. The stirring time must no be less than 3 min, to avoid uneven stirring of the slurry.

Grouting Operation

As required, the grouting pressure for each hole is strictly controlled. During grouting, close attention should also be paid to the slurry flow. When the pressure suddenly rises or drops, or the slurry overflows, the grouting should be stopped immediately. The cause of the abnormality must be identified and necessary measures must be taken before continuing the grouting. The grouting must be carried out continuously. If it is interrupted for a certain reason, the reason for the interruption should be found out, and treatment measures should be taken as soon as possible to resume the work as soon as possible. The grouting process should be constructed in sequence. In case of slurry stringing, the slurry stringing holes shall be grouted at the same time.

The dust control of grouting materials is carried out by on-site enclosures; the diffusion state of grouting is controlled by controlling the penetration capacity and coagulation speed of the slurry through the slurry proporation; the grouting pressure is controlled by constantly observing the dynamics of the floor and the value shown on the grouting pressure gauge and the skilled operation of the grouting machine.

Sealing the Holes

After the grouting is completed, the orifices of the holes are sealed and smoothed with cement mortar of the same grade or one grade higher than the floor.

In the step 5 of the embodiment of the disclosure, the lifting operation is carried out by intermittent cyclic lifting, and the daily lifting height is less than 10 mm.

Embodiment 2

Figure 2:
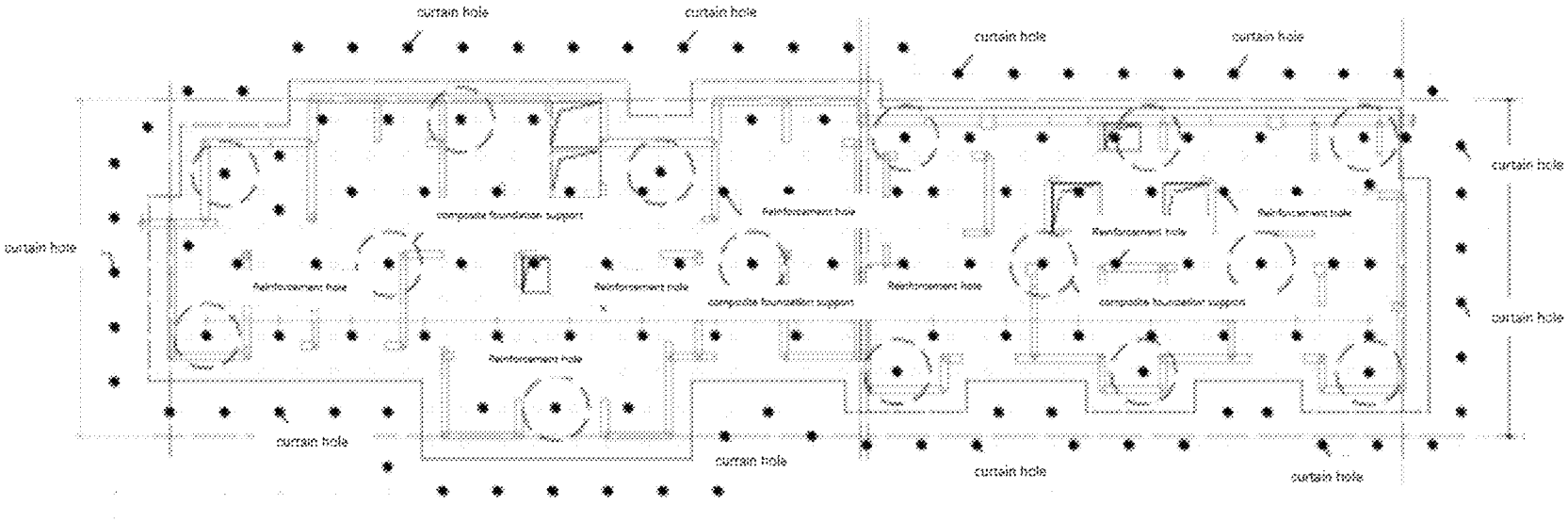
FIG. 2 is a schematic diagram showing the layout of the hole positions of Building 15 according to Embodiment 2 of the present disclosure.
Figure 3:
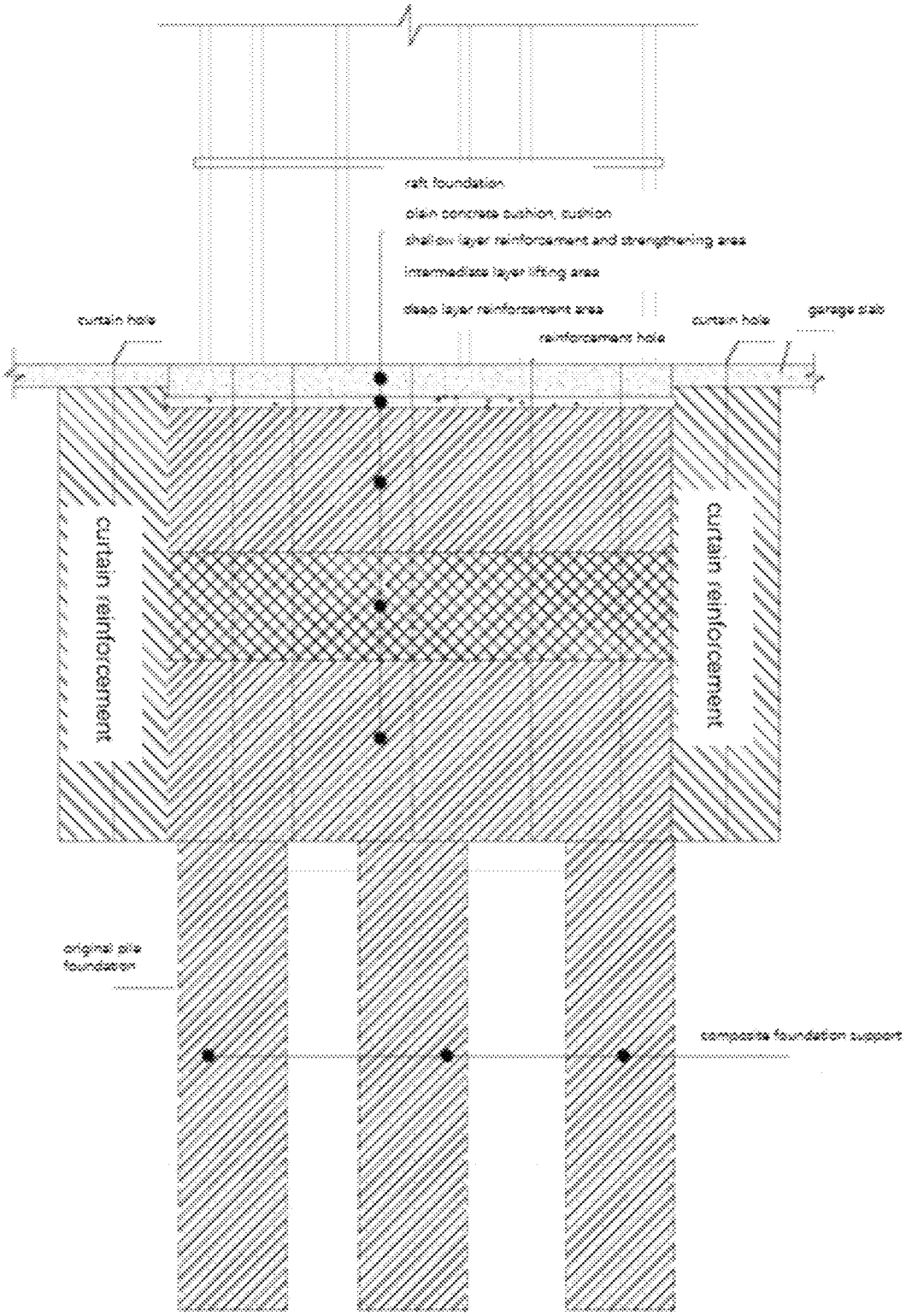
FIG. 3 is a schematic sectional view showing the reinforcement range of Building 15 according to Embodiment 2 of the present disclosure.

Referring to FIGS. 2-3, by an engineering method for reinforcing and lifting a sunken foundation of a residential building a reinforcement and lifting solution of the Residential Building 15 is taken as an example.

1. Arranging Hole Positions

Arranging the hole positions of the holes for curtain reinforcement and the hole depth thereof, in particular, the hole positions are arranged outside the building foundation slab with the spacing of the hole positions of about 2.5 m, and the hole depth is 12.0 m below the foundation slab (the actual hole positions and hole depth are adjusted according to the actual situation on site).

Arranging the reinforcement holes and and the hole depth of the reinforcement holes: the reinforcement holes are indoor arranged in plum blossom shape and drilled vertically, the spacing between the respective reinforcement holes is tentative 3.3 m, the drilling depth for reinforcing and strengthening the shallow layer is about 4.0 m below the foundation bottom, and the drilling depth for reinforcing the deep layer is 12 mm below the foundation bottom (entering the fifth layer of silt), the hole positions and hole depth should be adjusted according to the actual situation on site, so as to bypass shear walls and CFG piles, and the maximum hole spacing should not be greater than 4.0 m (see the hole positions layout diagram for details).

Arranging lifting holes: a part of the reinforcement holes is used as lifting holes arranged on a side of the sunken building with the hole depth of 4.0 m to 7.0 m below the foundation slab; if necessary, inclined holes are drilled outside the foundation slab or outdoors as the lifting holes, and the drilling depth is about 4.0 m to 7.0 m below the foundation slab (the hole positions of the outdoor and indoor lifting holes should be adjusted according to the actual situation on site).

2. Range of Reinforcement

The range of the curtain reinforcement: the range of the curtain reinforcement is the outward expansion by 3.0 m of the building foundation, and the reinforcement depth is 12.0 m below the foundation slab. The volume of the reinforcement body is about 6188 m3 (the total length of the curtain is 171.9 m, the width is 3.0 m, and the height is 12.0 m).

The range of the reinforcement and strengthening body for shallow layer: the reinforcement is carried out at the total area of the raft foundation, the plan area of the raft foundation is about 808.0 m2, the reinforcement depth is about 4.0 m below the foundation bottom, and the reinforcement range is adjusted according to the on-site drilling situation.

The range for reinforcing the deep layer: the plane reinforcement range is the total area reinforcement of the raft foundation, the plane area is about 808.0 m2, and the reinforcement depth is 7.0 m to 12.0 m below the bottom of the raft foundation;

The range for steadily lifting the intermediate layer: the stable lifting layer with about 3.0 m between the reinforcement and strengthening body for shallow layer and the reinforcement layer filled in the deep cave.

The foundation after the lifting, rectification and reinforcement of the building foundation forms an integral raft composite foundation reinforcement body. The volume of the integral reinforcement body is about 9696 m3 (the plane area of the reinforcement body is about 808.0 m2, and the reinforcement depth is 12.0 m)

The range of the supports of the composite foundation: 15 supports of the composite foundation are arranged under four corners of the building and under the main load-bearing walls. The effective diameter of the irregular composite pile foundation is not less than 3.0 m, the depth is 25.0 m below the foundation bottom (the reinforcement range is adjusted according to the on-site drilling conditions, and no less than 3.0 m below the original pile foundation bottom); the volume of the reinforcement body is about 1377.0 m3 (the effective diameter of the support of composite foundation support about 3.0 m, the length is 13.0 m, and there are 15 composite piles in total).

Embodiment 3

Figure 4:
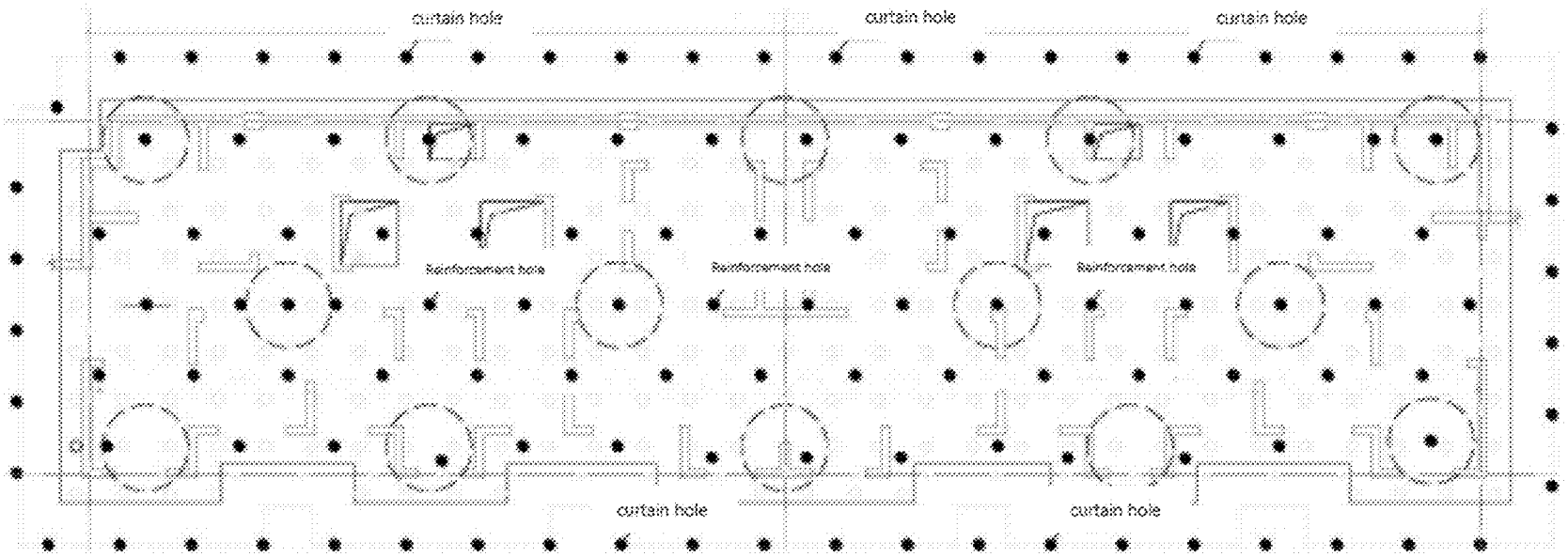
FIG. 4 is a schematic diagram showing the layout of the hole positions of Building 16 according to Embodiment 3 of the present disclosure.
Figure 5:
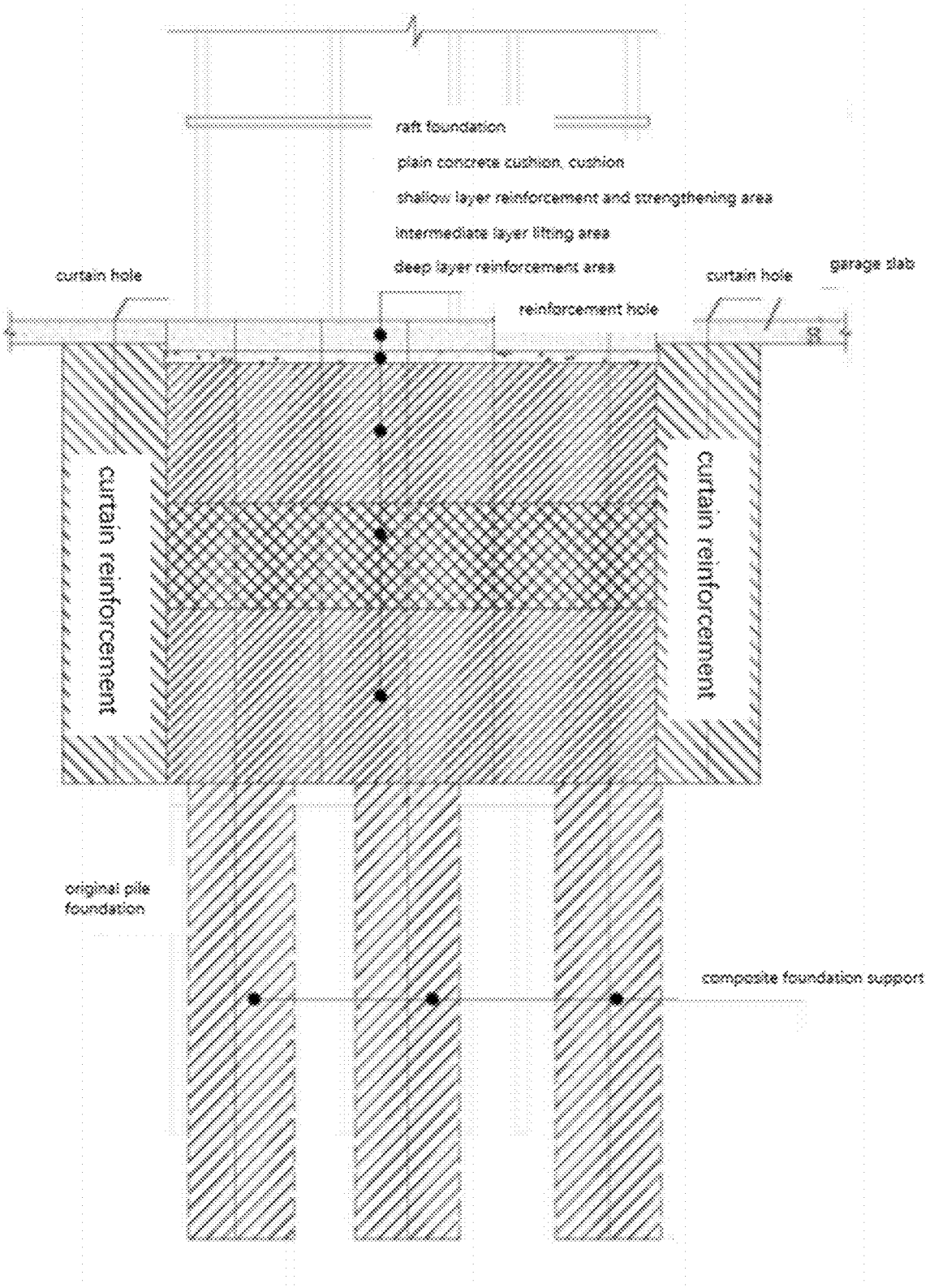
FIG. 5 is a schematic sectional view showing the reinforcement range of Building 16 according to Embodiment 3 of the present disclosure.

Referring to FIGS. 4-5, by an engineering method for reinforcing and lifting a sunken foundation of a residential building, a reinforcement and lifting solution of the Residential Building 16 is taken as an example.

1. Arranging Hole Positions

Arranging the hole positions of the holes for curtain reinforcement and the hole depth thereof, in particular, the hole positions are arranged outside the building foundation slab with the spacing of the hole positions of about 2.5 m, and the hole depth is 12.0 m below the foundation slab (the actual hole positions and hole depth are adjusted according to the actual situation on site).

Arranging the reinforcement holes and and the hole depth thereof, the reinforcement holes are indoor arranged in plum blossom shape and drilled vertically, the spacing between the respective reinforcement holes is tentative 3.3 m, the drilling depth for reinforcing and strengthening the shallow layer is about 4.0 m below the foundation bottom, which is carried out for the second layer of silt and the third layer of silty clay interspersed with silt, and the drilling depth for reinforcing the deep layer is 7.0 m-12 mm below the foundation bottom (entering the fifth layer of silt), the hole positions and the hole depth should be adjusted according to the actual situation on site, so as to bypass shear walls and CFG piles, and the maximum hole spacing should not be greater than 4.0 m (see the hole positions layout diagram for details).

Arranging lifting holes: a part of the reinforcement holes is used as lifting holes on a side of the sunken building with the hole depth of 4.0 m to 7.0 m below the foundation slab; if necessary, inclined holes are drilled outside the foundation slab or outdoors as the lifting holes, and the drilling depth is about 4.0 m to 7.0 m below the foundation slab (the hole positions of the outdoor and indoor lifting holes should be adjusted according to the actual situation on site).

2. Range of Reinforcement

The range of the curtain reinforcement: the range of the curtain reinforcement is the outward expansion by 3.0 m of the building foundation, and the reinforcement depth is 12.0 m below the foundation slab. The volume of the reinforcement body is about 5086 m3 (the total length of the curtain is 141.3 m, the width is 3.0 m, and the height is 12.0 m).

The range of the reinforcement and strengthening body for the shallow layer: the reinforcement is carried out at the total area of the raft foundation, the plan area of the raft foundation is about 708.0 m2, the reinforcement depth is about 4.0 m below the foundation bottom, and the reinforcement range is adjusted according to the on-site drilling situation.

The range for reinforcing the deep layer: the plane reinforcement range is the total area reinforcement of the raft foundation, the plane area is about 708.0 m2, and the reinforcement depth is 7.0 m to 12.0 m below the bottom of the raft foundation.

The range for steadily lifting the intermediate layer: the stable lifting layer with about 3.0 m between the reinforcement and strengthening body for shallow layer and the reinforcement layer filled in the deep cave.

The foundation after the lifting, rectification and reinforcement of the building foundation forms an integral raft composite foundation reinforcement body. The volume of the integral reinforcement body is about 8496 m3 (the plane area of the reinforcement body is about 708.0 m2, and the reinforcement depth is 12.0 m).

The range of the supports of the composite foundation: 15 supports of the composite foundation are arranged under four corners of the building and under the main load-bearing walls. The effective diameter of the irregular composite pile foundation is not less than 3.0 m, the depth is 25.0 m below the foundation bottom (the reinforcement range is adjusted according to the on-site drilling conditions, and no less than 3.0 m below the original pile foundation bottom); the volume of the reinforcement body is about 1285.0 m3 (the effective diameter of the support of composite foundation about 3.0 m, the length is 13.0 m, and there are 14 composite piles in total).

Embodiment 4

Figure 6:
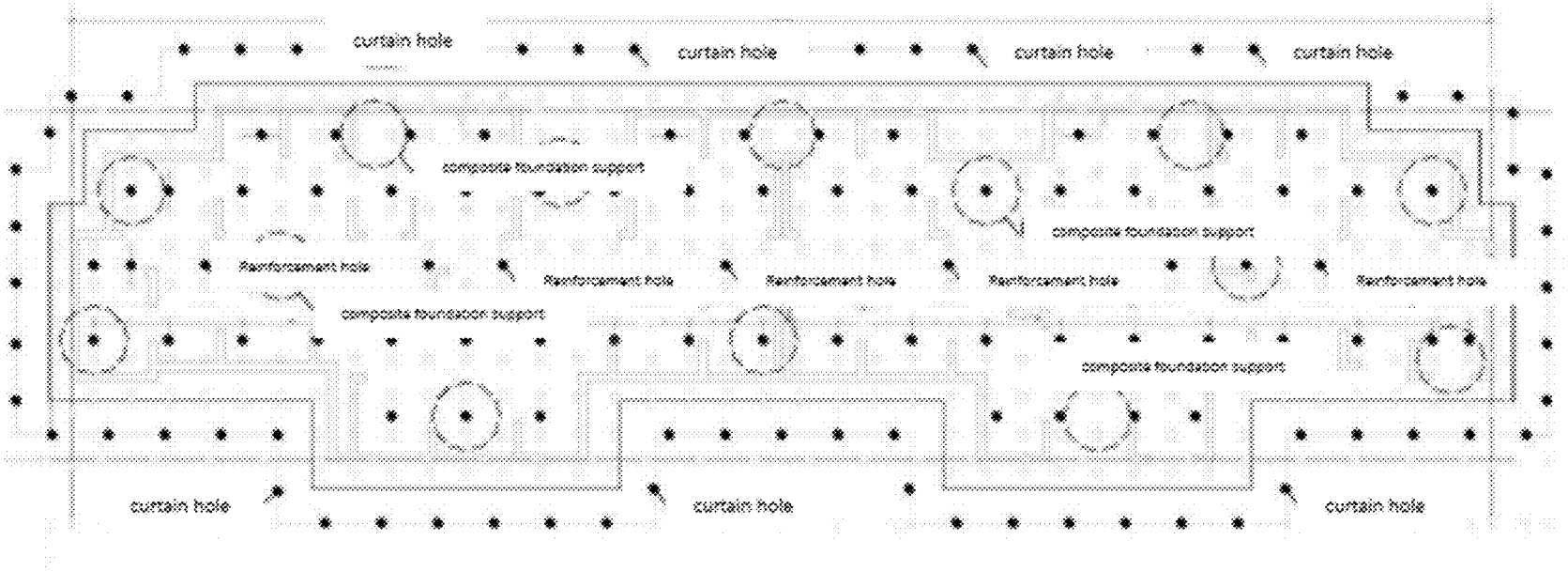
FIG. 6 is a schematic diagram showing the layout of the hole positions of Building 17 according to Embodiment 4 of the present disclosure.
Figure 7:
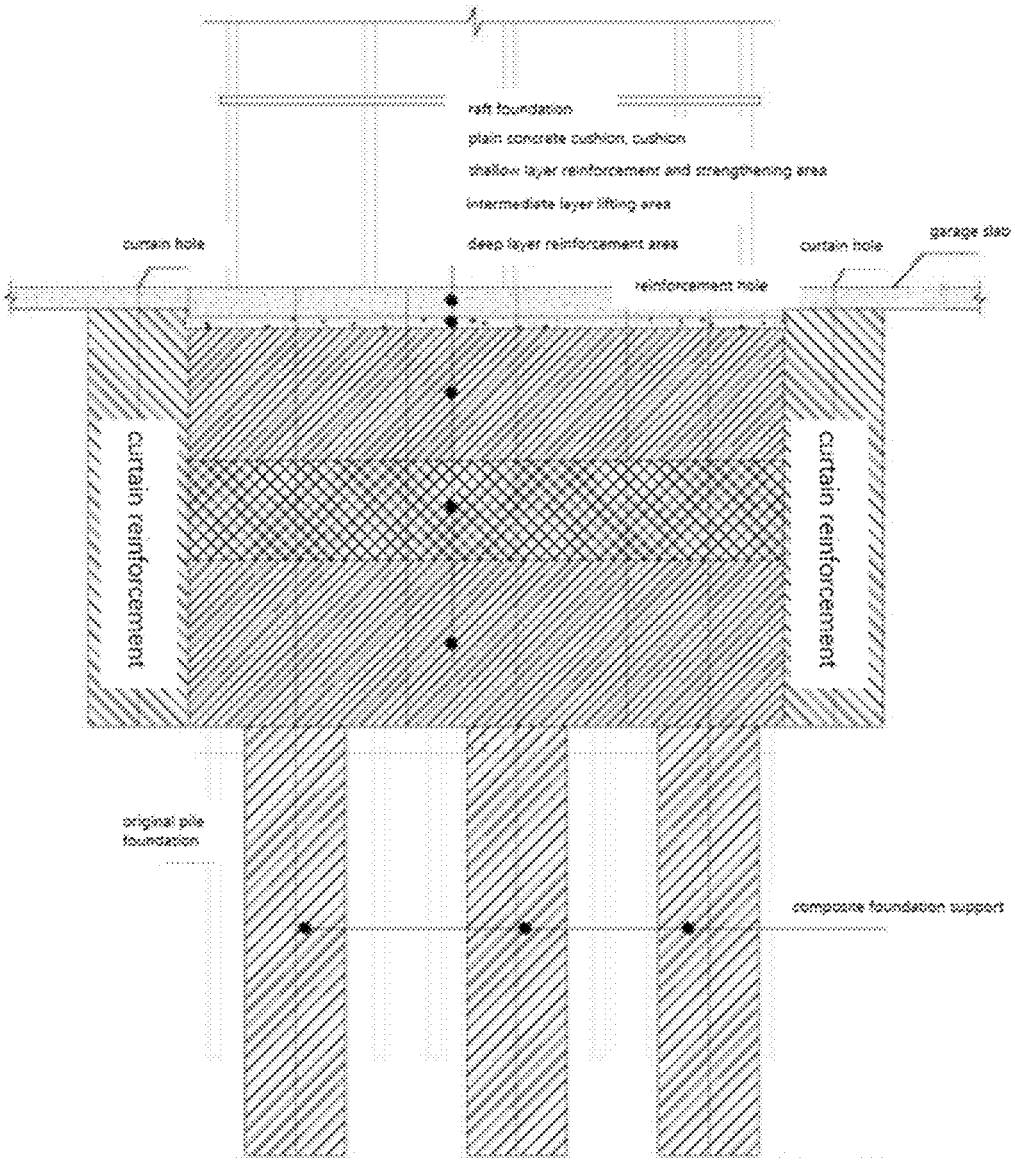
FIG. 7 is a schematic sectional view showing the reinforcement range of Building 17 according to Embodiment 4 of the present disclosure.

Referring to FIGS. 6-7, by an engineering method for reinforcing and lifting a sunken foundation of a residential building, a reinforcement and lifting solution of the Residential Building 17 is taken as an example.

1. Arranging Hole Positions

Arranging the hole positions of the holes for curtain reinforcement and the hole depth thereof, in particular, the hole positions are arranged outside the building foundation slab with the spacing of the hole positions of about 2.5 m, and the hole depth is 12.0 m below the foundation slab (the actual hole positions and hole depth are adjusted according to the actual situation on site).

Arranging the reinforcement holes and and the hole depth thereof, the reinforcement holes are indoor arranged in plum blossom shape and drilled vertically, the spacing between the respective reinforcement holes is tentative 3.3 m, the drilling depth for reinforcing and strengthening the shallow layer is about 4.0 m below the foundation bottom, which is carried out for the second layer of silt and the third layer of silty clay interspersed with silt, and the drilling depth for reinforcing the deep layer is 7.0 m-12 mm below the foundation bottom (entering the fifth layer of silt), the hole positions and hole depth should be adjusted according to the actual situation on site, so as to bypass shear walls and CFG piles, and the maximum hole spacing should not be greater than 4.0 m (see the hole positions layout diagram for details).

Arranging lifting holes: a part of the reinforcement holes is used as lifting holes on a side of the sunken building with the hole depth of 4.0 m to 7.0 m below the foundation slab; if necessary, inclined holes are drilled outside the foundation slab or outdoors as the lifting holes with the drilling depth of about 4.0 m to 7.0 m below the foundation slab (the hole positions of the outdoor and indoor lifting holes should be adjusted according to the actual situation on site).

2. Range of Reinforcement

The range of the curtain reinforcement: the range of the curtain reinforcement is the outward expansion by 3.0 m of the building foundation, and the reinforcement depth is 12.0 m below the foundation slab. The volume of the reinforcement body is about 6660 m3 (the total length of the curtain is 185 m, the width is 3.0 m, and the height is 12.0 m).

The range of the reinforcement and strengthening body for shallow layer: the reinforcement is carried out at the total area of the raft foundation, the plan area of the raft foundation is about 980.0 m2, the reinforcement depth is about 4.0 m below the foundation bottom, and the reinforcement range is adjusted according to the on-site drilling situation.

The range for reinforcing the deep layer: the plane reinforcement range is the total area reinforcement of the raft foundation, the plane area is about 980.0 m2, and the reinforcement depth is 7.0 m to 12.0 m below the bottom of the raft foundation.

The range for steadily lifting the intermediate layer: the stable lifting layer with about 3.0 m between the reinforcement and strengthening body for shallow layer and the reinforcement layer filled in the deep cave.

The foundation after the lifting, rectification and reinforcement of the building foundation forms an integral raft composite foundation reinforcement body. The volume of the integral reinforcement body is about 11760 m3 (the plane area of the reinforcement body is about 980.0 m2, and the reinforcement depth is 12.0 m).

The range of the supports of the composite foundation: 15 supports of the composite foundation are arranged under four corners of the building and under the main load-bearing walls. The effective diameter of the irregular composite pile foundation is not less than 3.0 m, the depth is 25.0 m below the foundation bottom (the reinforcement range is adjusted according to the on-site drilling conditions, and no less than 3.0 m below the original pile foundation bottom); the volume of the reinforcement body is about 1285.0 m3 (the effective diameter of the support of composite foundation about 3.0 m, the length is 13.0 m, and there are 14 composite piles in total).

Working principle: "reinforcing and strengthening the shallow layer", "reinforcing and lifting the intermediate layer" are used to form a raft composite foundation, and "reinforcement support of the deep layer composite foundation" forms a pile-like support, so as to achieve the purpose of reinforcement and lifting of the building foundation, which improves the overall stability and bearing capacity of the building foundation.

It is obvious to those skilled in the art that the present disclosure is not limited to the details of the above exemplary embodiments, but can be implemented in other specific forms without departing from the spirit or essential features of the present disclosure. Therefore, the embodiments should be considered in all respects as illustrative and non-restrictive, and the scope of the disclosure is defined by the appended claims rather than the foregoing description, and it is therefore intended that all changes falling within the meaning and range of equivalent elements of the claims are included in the present disclosure. Any reference sign in a claim should not be construed as limiting the claim concerned.

In addition, it should be understood that although the present specification is described according to implementations, not every implementation includes only one independent technical solution. This narrative method of the specification is only for the sake of clarity. Those skilled in the art should regard the specification as a whole. The technical solutions in each embodiment may also be appropriately combined to form other implementations that can be understood by those skilled in the art.

What is claimed is:

1. An engineering method for reinforcing and lifting a sunken foundation of a residential building, comprising:

Step 1: stratifying a stratum within an exploration depth according to soil type, color, state and inclusions, Step 2: conducting a curtain grouting reinforcement around the residential building, to form a curtain wall around the sunken foundation, Step 3: reinforcing and strengthening a shallow layer, wherein a silty clay layer under a foundation slab of the residential building is reinforced and strengthened to yield a reinforced and strengthened shallow layer, to improve a density and rigidity of a soil layer of foundation, Step 4: reinforcing a deep layer to yield a reinforced deep layer, wherein drilling continues down to a silt layer, and a retreating layered reinforcement of soil around an original pile is started, to increase a friction resistance of the soil around the original pile and form an integral stone body, Step 5: steadily lifting reinforcement supports of the reinforced and strengthened shallow layer and the reinforced deep layer in an intermediate layer on a settlement side after the reinforcement supports are formed, wherein a grouting pressure and a slurry proportion are adjusted on the settlement side to continuously fill and compact the soil layer of foundation with a slurry, after the sunken foundation is reinforced and lifted, an integral raft composite foundation is formed, and a part of reinforcement holes is used as lifting holes on a side of the residential building with a hole depth of 4.0 m to 7.0 m below the foundation slab, and Step 6: constructing second reinforcement supports of the integral raft composite foundation, wherein a plurality of the second reinforcement supports of the integral raft composite foundation are constructed under the integral raft composite foundation formed after building reinforcement and lifting meets requirements.

2. The engineering method for reinforcing and lifting a sunken foundation of a residential building according to claim 1, wherein in the step 1, characteristics and distribution of the stratum comprises:

a first layer being a slightly dense silt layer having the following characteristics:

yellowish brown, wet, slightly dense, quick shaking response, uniform soil, no glossiness, low dry strength, low toughness, locally manifested as a thin layer of loose silt sand, with a surface layer as a cultivated soil, containing a small amount of plant roots, and partially interspersed with plastic silty clay;

a second layer being a slightly dense silty clay layer having the following characteristics:

yellowish brown, wet, slightly dense, medium shaking response, uniform soil, no glossiness, low dry strength, low toughness, containing iron spots, mica sheets and small amount of ginger stone, high local clay content, interspersed with a thin layer or a lens of soft plastic-plastic silty clay, a third layer being a medium density silt layer having the following characteristics:

yellowish brown, wet, medium dense, low dry strength, quick shaking response, no glossiness, low toughness; locally interspersed with a thin layer of silt sand, relative high content of sand particles, with main components of quartz and feldspar, discontinuous distribution, and locally pinching out;

a fourth layer being silt layer interspersed with silty clay having the following characteristics:

yellowish brown-brownish gray, wet, slightly dense, medium shaking response, no glossiness, low dry strength, low toughness, interspersed with a thin layer or a lens of soft plastic-plastic silty clay;

a fifth layer being a silt layer having the following characteristics:

yellowish brown, wet, slightly dense, low dry strength, medium shaking response, no glossiness, low toughness; locally mixed with a powdery thin layer, containing a small amount of mica sheets and iron oxides;

a sixth layer being a plastic silty clay layer having the following characteristics:

gray brown, mainly plastic, medium dry strength, no shaking response, medium toughness, slightly glossy, with small amounts of iron oxides, small ginger stones, calcium nodules, and snail scraps, locally interspersed with a medium dense hard layer of silt;

a seventh layer being a fine sand layer having the following characteristics:

yellowish brown, saturated, dense, with average particle size distribution, with main mineral components of quartz and feldspar, containing iron and manganese, mica sheets, occasional snail debris and small ginger stone; and an eighth layer being a plastic-hard plastic silty clay layer having the following characteristics:

brownish yellow, plastic-hard plastic, medium dry strength, no shaking response, medium toughness, slightly glossy, with a small number of calcareous nodules and snail crumbs, locally interspersed with a medium dense thin layer of silt, a ninth layer being a fine sand layer.

3. The engineering method for reinforcing and lifting a sunken foundation of a residential building according to claim 1, wherein in the step 2, a retreating layered reinforcement by a jumping drilling method is adopted for construction, a drill rod is lifted 0.5 to 1.0 m after each section is reinforced, the retreating layered reinforcement is continued and circulated upward to the foundation slab, hole positions of holes for curtain reinforcement are outside the foundation slab, and a range of the curtain reinforcement is formed by an outward expansion of the sunken foundation.

4. The engineering method for reinforcing and lifting a sunken foundation of a residential building according to claim 3, wherein in the step 2 and step 3, the holes are all indoor arranged in plum blossom shape and drilled vertically, a drilling depth for reinforcing and strengthening the shallow layer is 4.0 m below the foundation slab, and a drilling depth for reinforcing the deep layer is 7.0 m to 12 mm below the foundation slab, and a range for reinforcing and strengthening the shallow layer and a range for reinforcing the deep layer are both a total area reinforcement of the integral raft composite foundation.

5. The engineering method for reinforcing and lifting a sunken foundation of a residential building according to claim 1, wherein in the step 5, the slurry is a high-aluminum-iron composite slurry for grouting construction, wherein the slurry is filled into gaps in the soil layer of foundation and consolidated to a new structure.

6. The engineering method for reinforcing and lifting a sunken foundation of a residential building according to claim 1, wherein in the step 6, the reinforcement supports of the integral raft composite foundation are arranged under four corners of the residential building and under main load-bearing walls.

7. The engineering method for reinforcing and lifting a sunken foundation of a residential building according to claim 1, wherein during a grouting construction, a grouting pressure for reinforcement is 0.3 to 1.2 MPa, and a grouting pressure for lifting is 0.5 to 2.5 MPa.

8. The engineering method for reinforcing and lifting a sunken foundation of a residential building according to claim 1, wherein during a grouting construction, the method comprises:

marking determined positions, wherein the reinforcement holes are vertically or obliquely drilled at the determined positions, after a drilling rig is in place, the drilling rig is leveled and centered, an angle of a drill rod is adjusted, and after the drilling rig is aligned with a hole position, the drilling rig is not moved, before drilling, a concrete protective layer is removed and the reinforcement holes are formed between adjacent rebars, wherein a record during the drilling is taken to provide reference data for grouting operations, filtering the slurry that is stirred through a screen before entering a grouting machine, controlling the grouting pressure for each of the reinforcement holes and observing a flow of the slurry, controlling a dust of grouting materials by on-site enclosures, wherein a diffusion state of the grouting materials is controlled by controlling a penetration capacity and a coagulation speed of the slurry through the slurry proportion, and the grouting pressure is controlled by constantly observing dynamics of a floor and a value shown on a grouting pressure gauge, sealing and smoothing orifices of the reinforcement holes with cement mortar of a same grade or one grade higher than the floor after the grouting is completed.

9. The engineering method for reinforcing and lifting a sunken foundation of a residential building according to claim 1, wherein in the step 5, the lifting is carried out by intermittent cyclic lifting, and a daily lifting height is less than 10 mm.

* * * * *